US005386788A

United States Patent [19]

Linker et al.

[11] Patent Number: 5,386,788

[45] Date of Patent: Feb. 7, 1995

[54] MODULAR, SECURITY ENCLOSURE AND METHOD OF ASSEMBLY

[75] Inventors: Kevin L. Linker; John W. Moyer, both of Albuquerque, N. Mex.

[73] Assignee: Sandia Corporation, Albuquerque, N. Mex.

[21] Appl. No.: 975,048

[22] Filed: Nov. 12, 1992

[51] Int. Cl.[6] ..... E04B 2/08

[52] U.S. Cl. ..... 109/58; 52/264; 52/271; 52/285.1; 52/582.2; 52/586.1; 109/64; 109/79

[58] Field of Search ..... 109/78, 79, 58, 64, 109/76, 80, 82–85, 87; 52/271, 285.1, 586.1, 586.2, 582.1, 582.2, 264, 270

[56] References Cited

U.S. PATENT DOCUMENTS

| | | | |
|---|---|---|---|
| 20,736 | 6/1858 | Sharts . | |
| 679,372 | 7/1901 | Hibbard . | |
| 701,688 | 6/1902 | Donnell | 109/79 |
| 1,194,305 | 8/1916 | McMillan | 52/271 |
| 1,254,136 | 1/1918 | Hastings | 52/271 |
| 1,351,133 | 8/1920 | Scharwath | 52/271 |
| 1,365,726 | 1/1921 | Potts | 109/84 |
| 1,467,340 | 9/1923 | Siegel | 52/591 X |
| 1,974,427 | 9/1934 | Knight | 52/271 |
| 2,921,347 | 1/1960 | Solomon | 52/262 |
| 3,012,639 | 12/1961 | Pavlecka | 52/481 |
| 3,462,181 | 8/1969 | Lewis | 52/594 X |
| 3,618,991 | 11/1971 | Edwards et al. . | |
| 3,771,277 | 11/1973 | Rausch et al. | 52/580 |
| 4,158,338 | 6/1979 | Dippold et al. | 109/79 |
| 4,231,203 | 11/1980 | Mikkelsen et al. | 52/284 |
| 4,388,874 | 6/1983 | Stone | 109/79 |
| 4,389,948 | 6/1983 | Sands et al. | 109/82 |
| 4,559,881 | 12/1985 | Lankard et al. | 109/83 |
| 4,754,715 | 7/1988 | Squires | 109/59 T |
| 4,765,254 | 8/1988 | Goldman | 109/85 |
| 5,072,554 | 12/1991 | Hayman | 52/79.1 |
| 5,107,652 | 8/1992 | Sosa | 52/578 |

FOREIGN PATENT DOCUMENTS

| | | | |
|---|---|---|---|
| 246186 | 12/1960 | Australia | 52/271 |
| 0013852 | 8/1980 | European Pat. Off. | 52/586.2 |
| 858767 | 4/1953 | Germany | 52/586 |
| 2040082 | 2/1972 | Germany | 52/586 |
| 0234737 | 2/1945 | Switzerland | 52/285.1 |
| 4294 | of 1886 | United Kingdom | 109/79 |
| 1287897 | 9/1972 | United Kingdom | 52/285.1 |

*Primary Examiner*—Lloyd A. Gall

*Attorney, Agent, or Firm*—George H. Libman; Timothy D. Stanley

[57] ABSTRACT

A transportable, reusable rapidly assembled and disassembled, resizable modular, security enclosure utilizes a stepped panel construction. Each panel has an inner portion and an outer portion which form joints. A plurality of channels can be affixed to selected joints of the panels. Panels can be affixed to a base member and then affixed to one another by the use of elongated pins extending through the channel joints. Alternatively, the base member can be omitted and the panels themselves can be used as the floor of the enclosure. The pins will extend generally parallel to the joint in which they are located. These elongated pins are readily inserted into and removable from the channels in a predetermined sequence to allow assembly and disassembly of the enclosure. A door constructed from panels is used to close the opening to the enclosure.

22 Claims, 8 Drawing Sheets

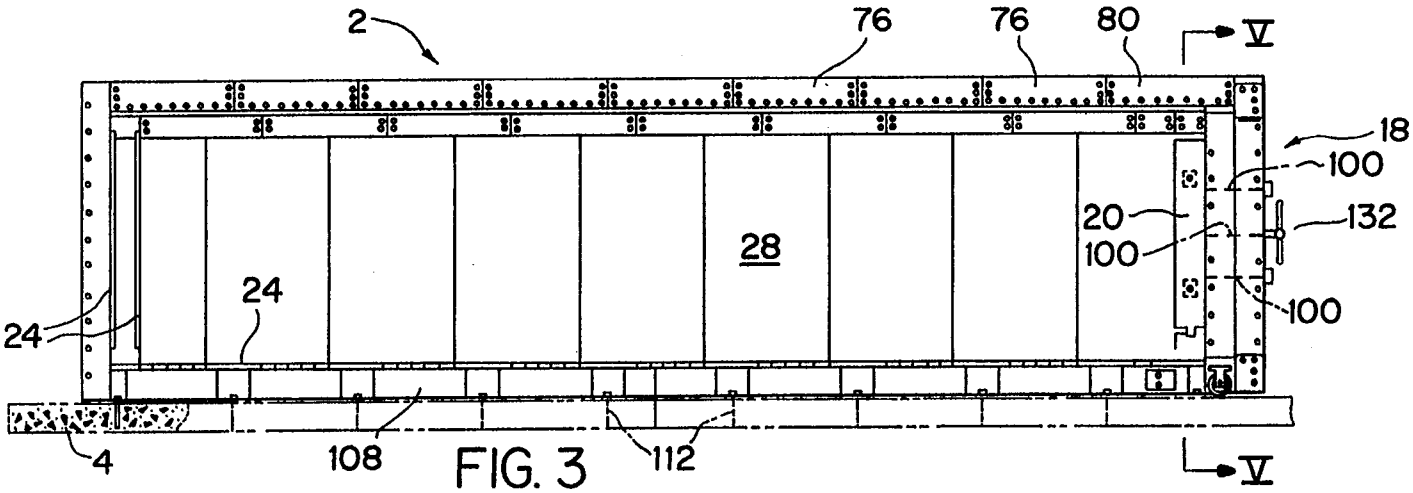
FIG. 3
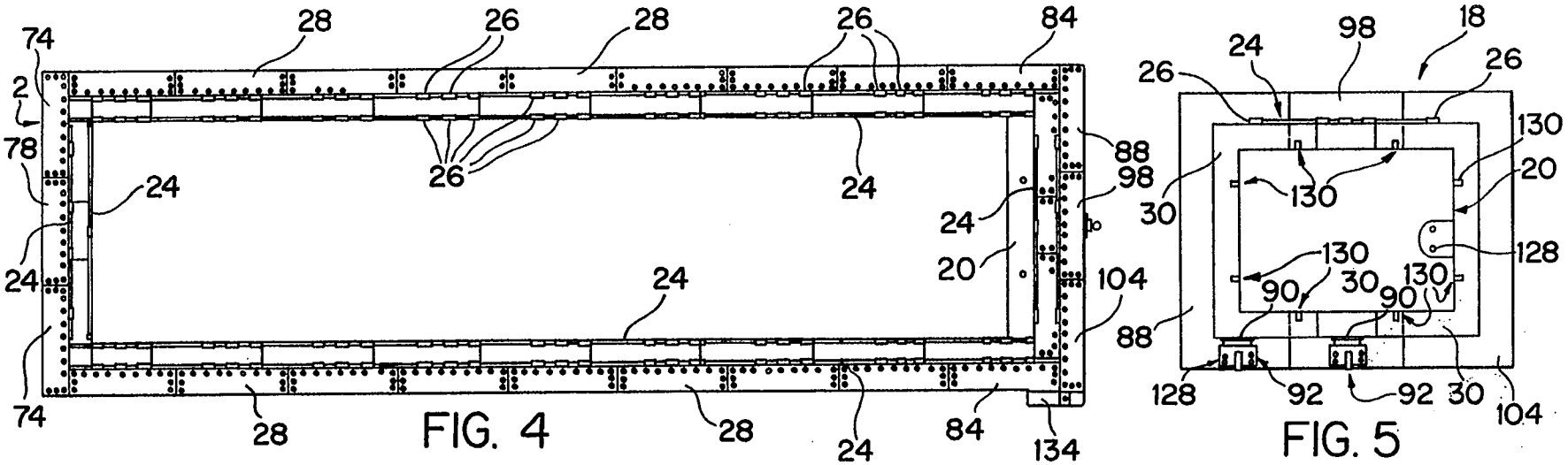
FIG. 4
FIG. 5

X
X

MODULAR, SECURITY ENCLOSURE AND METHOD OF ASSEMBLY

BACKGROUND OF THE INVENTION

1. Field of the Invention

The present invention relates to a transportable, reusable, rapidly assembled and disassembled, re-sizable modular, security enclosure. This enclosure utilizes elongated pins connected to channels on individual panels.

2. Description of the Background Art

Various modular security enclosures are known. While existing modular vaults offer a certain level of security, they are very heavy. These prior art vaults are also complicated to assemble and disassemble. In fact, disassembly can destroy part of the vault making it difficult, if not impossible, to reuse.

Current modular vaults rely on many welded and bolted connections during assembly. As a result, a fork lift, an arch welder, a hammer, a drill and wrenches, for example, are needed in order to assemble the vault. This approach is both time consuming and requires additional equipment and specialized personnel for assembly. Disassembly of such a vault can also be very time consuming. The many welds must be ground or cut off and bolts must be removed.

In addition, the connection points in prior art modular vaults are not concealed within the vault wall. If an adversary were to penetrate the vault, further panels could easily be removed due to the exposed inner connections. Therefore, any wall could be a vulnerable point to further penetration.

Additionally, the door of existing modular vaults is normally a completely separate unit. Such a door with its lock mechanism and door frame tends to be large and heavy. These doors require special handling.

Accordingly, a need in the art exists for a simple modular, security enclosure which can be easily assembled and disassembled. The size of this enclosure should be variable and no special equipment should be needed to assemble or disassemble this enclosure. In fact, a need exists for a security enclosure which can be manually transported and assembled. Accordingly, such a security enclosure could be located in areas which do not now normally utilize a vault. Moreover, a need exists for a security enclosure which will not be readily disassembled if an adversary penetrates a portion of this enclosure. Such an enclosure should also avoid a heavy door and the entire enclosure should be relatively light.

SUMMARY OF THE INVENTION

Accordingly, it is a primary object of the present invention to provide a modular, security enclosure which offers a desired level of security.

It is a further object of the present invention to provide a security enclosure which can be quickly assembled and disassembled without damage to the enclosure.

A further object of the present invention is to provide a security enclosure which can be manually transported and assembled without the need for special equipment or skilled personnel.

Yet a further object of the present invention is to provide a security enclosure which can be utilized in areas not normally available to existing vaults.

Still another object of the present invention is to provide a security enclosure which can vary its size as needed.

Another object of the present invention is to provide a security enclosure which cannot be readily disassembled if an adversary penetrates a portion of the enclosure.

Still another object of the present invention is to provide a security enclosure which is reusable and which is light weight.

Another object of the present invention is to provide a security enclosure with a door that is not heavy and does not require special handling.

Still a further object of the present invention is to provide a security enclosure which is easy to manufacture, relatively inexpensive and requires limited to no maintenance.

These and other objects of the present invention are fulfilled by a modular, security enclosure which comprises a plurality of panels, a plurality of channels on the panels and elongated pins which extend through the channels. Each panel has interfitting, stepped edges which can be joined in a particular sequence on a base member secured to a surface on which the enclosure is to rest. The panels each have inner and outer portions with the edges of the inner portion being offset from the edges of the outer portion. Joints are formed between the inner and outer portions of the panels with channels being affixed to selected joints. Normally, two rows of channels will be provided on a panel.

When the stepped edges of the panels are interfit, the channels in the two rows on each respective panel will align such that the elongated pins can be placed through the channels. In this manner, the adjacent panels will be locked together. The pins extend generally parallel to the joints in which they are located. These pins are readily inserted into and removable from the channels in a predetermined sequence. In that manner, assembly and disassembly of the security enclosure can be easily carried out. The pins are concealed and inaccessible from the exterior of the enclosure when the pins are in the channel. In that manner, if an adversary were to penetrate the enclosure, he or she would be unable to remove additional panels to widen the opening in the enclosure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a sectional side view of the security enclosure of the present invention;

FIG. 4 is a sectional top, plan view of the security enclosure of the present invention;

FIG. 5 is a sectional view of the front end of the security enclosure taken along line V—V in FIG. 3;

DETAILED DESCRIPTION OF THE PREFERRED EMBODIMENTS

Figure 1:
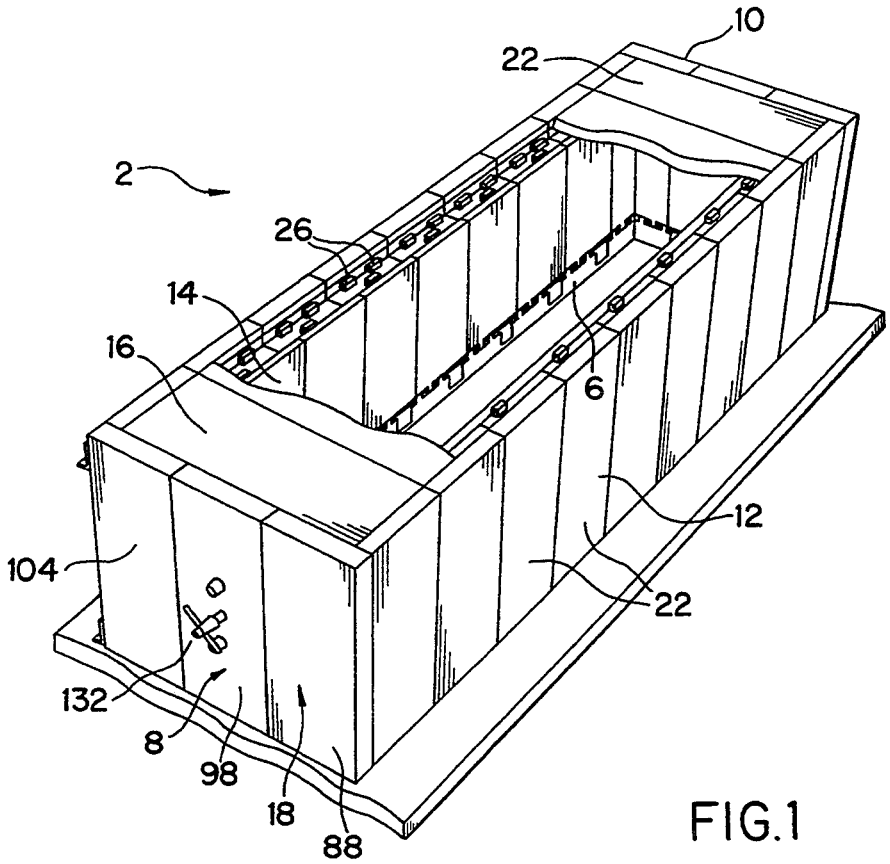
FIG. 1 is a perspective view of the security enclosure of the present invention with a portion of the top removed.

Referring in detail to the drawings and with particular reference to FIG. 1, a security enclosure 2 of the present invention is shown. This security enclosure is mounted on surface 4. Base member 6 is affixed to surface 4 as will be described in detail below.

Figure 2:
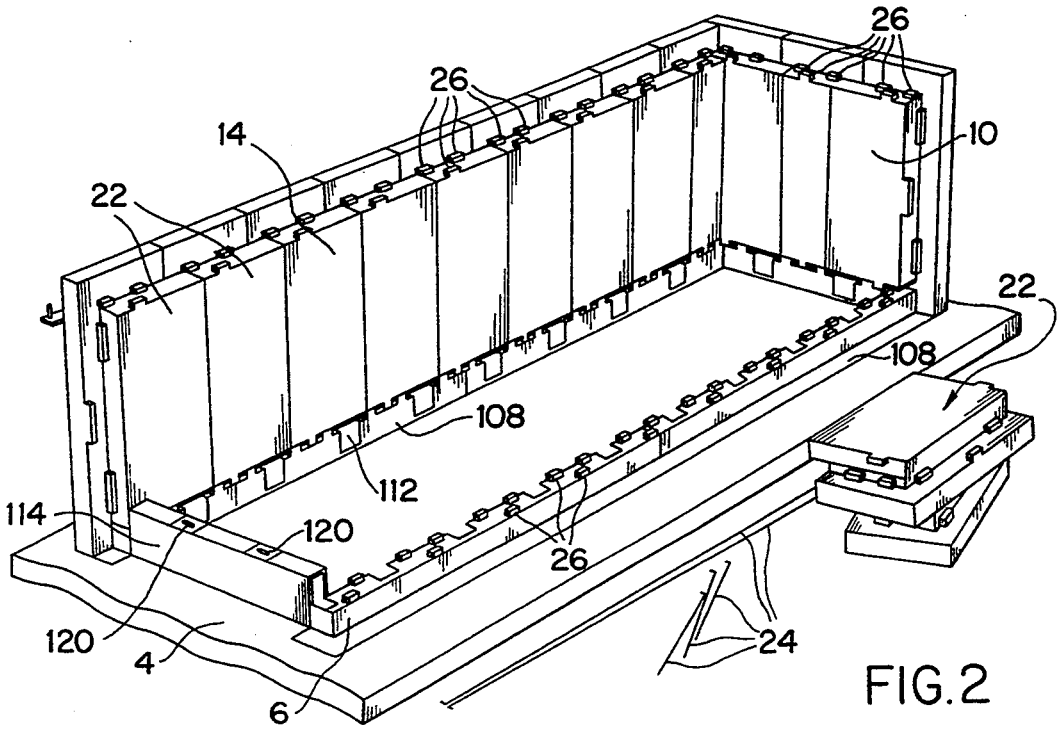
FIG. 2 is a perspective view of the security enclosure of the present invention during assembly thereof.

The security enclosure 2 includes a front 8, rear 10, first side 12, second side 14 and top 16. The front 8 of the enclosure 2 has a door 18. A lock 20 is provided on this door with a handle 132. As seen in FIGS. 1 and 2, the enclosure 2 of the present invention is made up of a plurality of panels 22. There is some variation in these panels 22 as will be discussed in detail below. The panels 22 are mounted to the base member 6 by elongated pins 24 extended through channels 26 on the panels. This interlocking arrangement will be described in more detail below.

It should be noted that the panels are relatively small and sufficiently light weight such that they can be manually handled. In this manner, the security enclosure 2 of the present invention can be assembled or disassembled solely with man power. Special equipment such as a fork lift or welder is not needed. In fact, a rotary drill hammer, regular hammer, slide hammer and an open end wrench can be sufficient for assembly and disassembly of the present security enclosure.

Before discussing the assembly and disassembly of the security enclosure 2, the individual panel construction will now be explained. One type of panel is shown in FIGS. 7–10. This z-shaped side assembly panel 28 consists of an inner portion 30 and an outer portion 32. As can be seen in the top, plan view of FIG. 9, these portions 28, 32 give the panel 28 its z-shape.

In such z-shaped panels, the upper edge 34 of the inner portion 30 and the lower edge 36 of the inner portion 30 have generally the same length as the upper edge 38 of the outer portion 32 and the lower edge 40 of the outer portion 32; however, the side edges 42, 44 of the inner portion 30 are shorter than the side edges 46, 48 of the outer portion 32. In this manner, the upper and lower edges 34, 36 of the inner portion 30 are between the upper and lower edges 38, 40 of the outer portion 32. On the other hand, one side edge 42 of the inner portion 30 is between the two side edges 46, 48 of the outer portion 32. In this manner, the inner and outer portions 30, 32 overhang one another. This design enables interfitting of the stepped edges of the panels as will be described in more detail below.

Figures 7, 8, 9, 10:
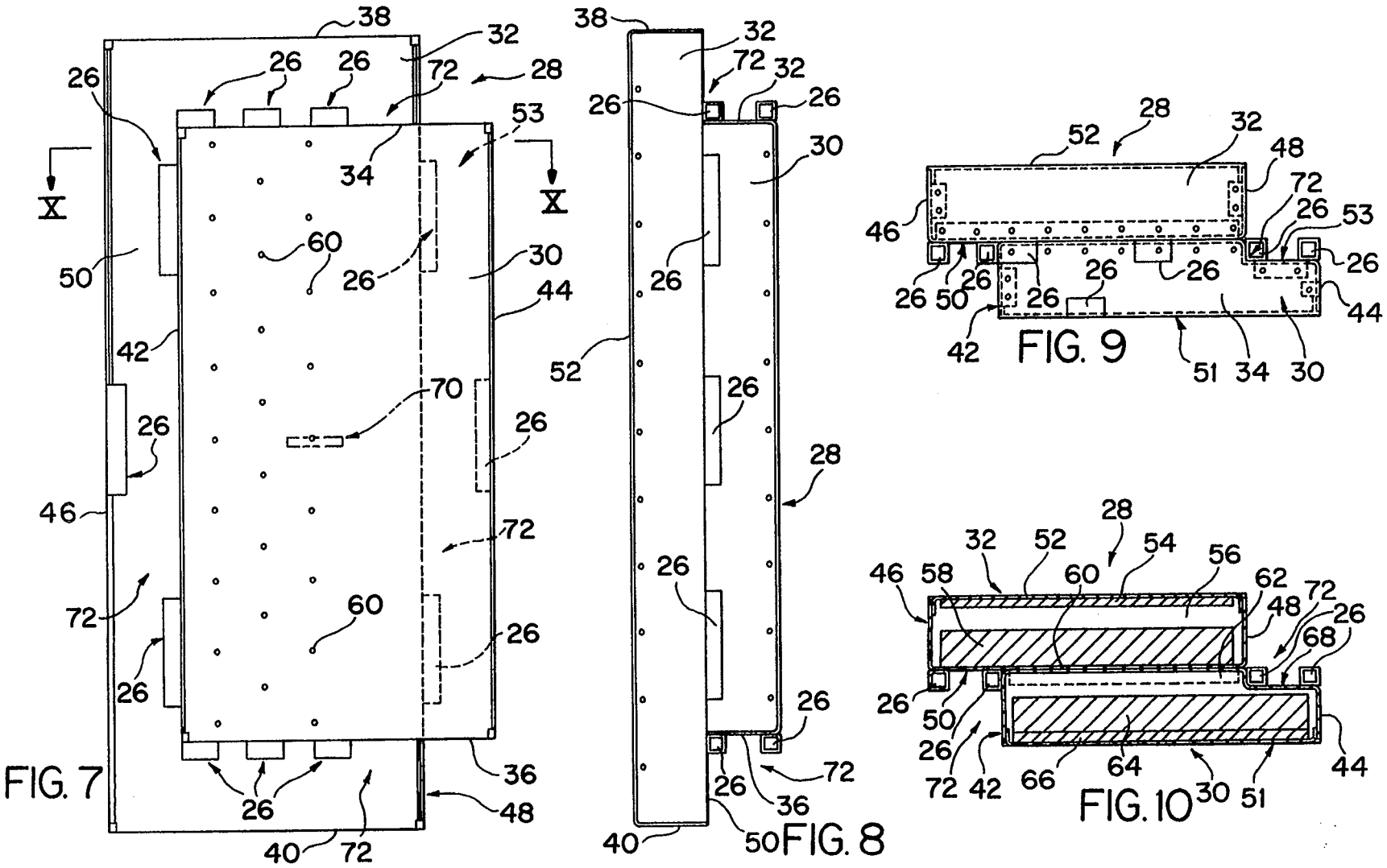
FIG. 7 is a front view of a z-shaped side assembly panel of the present invention.
FIG. 8 is a side view of the panel shown in FIG. 7.
FIG. 9 is a top, plan view of the panel shown in FIG. 7.
FIG. 10 is a sectional view of the panel shown in FIG. 7 taken along line X—X.

In the z-shaped side assembly panel 28 shown in FIGS. 7–10, channels 26 are provided at predetermined locations. As shown in FIG. 9, a total of three channels 26 in two rows are provided along the upper edge 34 of the inner portion 30. Two channels 26 are provided adjacent the inner face of the outer portion 32 while one channel 26 is on the opposed side of edge 34. It should be recognized that while only three channels are used in this embodiment, any suitable number of channels can be provided.

As can be seen in FIG. 9, the two channels 26 on edge 34 adjacent the inner face of the inner portion 30 are aligned. When the panels are interfit together, these channels 26 will have a third channel positioned thereinbetween. Similarly, the single channel 26 on the outer side of edge 34 will have two other channels aligned therewith when the panels are interfit together as will be described in more detail.

Apart from the channels 26 on the upper edge 34 of the inner portion 30, three channels are provided on the lower edge 36 of inner portion 30 as seen, for example in FIGS. 7 and 8. These channels 26 on the lower edge 36 are arranged similarly to the channels 26 on the upper edge 34. Vertically extending channels 26 are also provided on the inner face 50 of the outer portion 32.

Accordingly, on each side of the inner portion 30 of the z-shaped assembly panel 28, two rows of channels 26 are provided. Like the channels 26 on the upper edge 34 of the inner portion 30, these channels 26 on the inner face 50 of the outer portion 32 will align with other channels when the panels are interfit together. The staggered arrangement of the channels enables adjacent panels to be mounted in a noninterferring position. When elongated pins 24 are slid through channels 26, adjacent panels will be locked together. For example, when the z-shaped side assembly panel 28 is positioned next to another z-shaped side assembly panel 28, two rows each having three channels 26 will be present. Two of the channels 26 will be on one of the panels while a single one of the other channels will be on the other panel in each row. These aligned channels will receive the elongated pins 24 in order to lock the adjacent panels together. While three channels 26 are discussed as being in a row of adjacent panels, it should be appreciated that any number of channels 26 can be provided along a panel. It is merely necessary that the channels on a first panel are positioned such that they are in alignment with channels on an abutting panel in order to receive the elongated pins 24. The panel construction can be seen in the cross-sectional view of FIG. 10. While FIG. 10 shows a z-shaped side assembly panel 28, this construction is equally applicable to all panels of the present invention.

The outer portion 32 of the panel has an outer barrier material 54. Adjacent to this material 54 is a second barrier material 56 and then a third barrier material 58. The particular material used in these layers should be known to those skilled in the art.

The outer portion 32 and inner portion 30 can be connected by a solid flush rivet 60 or any other suitable means. On the inner portion, a first barrier material 62 is provided adjacent the outer portion 32. Next to this barrier material 62 is a second barrier material 64 and then a third barrier material 66. A steel band or other appropriate structure can encircle the edges of the inner and outer portions 30, 32, if so desired. Accordingly, each panel 22 of the present invention consists of a plurality of barrier materials strategically located within the panel to resist various types of attack. Each barrier material is optionally enclosed in a frame and outer metal skin 68 to result in the individual panels 22.

By constructing single smaller panels, the weight of each panel 22 of the present invention is easily manageable. This described panel of course is not limited to the particular design given above but can have any suitable construction. Panels can be designed for a particular security or safeguard level.

In order to aide assembly of the enclosure 2, indicia 70 can be provided on each panel. In that way, individual panels can be easily distinguished such that the security enclosure 2 can be rapidly assembled. The indicia 70 are not shown on each of the panels for simplicity; however, it should be appreciated that an appropriate indicia 70 could be provided on each of the panels 22. Of course the location of the indicia 70 on the panels can be varied.

In the z-shape side assembly panel 28, four joints 72 are provided. A first joint is formed between the upper edge 34 of the inner portion 30 and the inner face 50 of the outer portion 32. A next joint is formed between the side edge 42 of the inner portion 30 and the inner face 50 of the outer portion 32. The next joint is formed between the lower edge 36 of the inner portion 30 and the inner face 50 of the outer portion 32. The last joint is formed between the side edge 48 of the outer portion 32 and the outer face 53 of the inner portion 30. The channels 26 will be located in joints 72 in each of the panels 22.

While the outer face 53 of the inner portion 30 is generally flat, it is noted that the inner face 51 of the inner portion 30 is bent as shown, for example, in FIG. 9. Of course, any configuration for the faces 51, 53 of the inner portion 30 and faces 50, 52 of the outer portion 32 is possible.

The remaining panels 22 of the present invention have a similar design to the z-shaped side assembly panel 28 as has been described with regard to FIGS. 7 and 10. However, the locations of the channels 26 vary. Moreover, some panels 22 have a t-shape instead of a z-shape. The designs for the remaining panels which form the present security enclosure 2 will now be described in detail.

Figures 11, 12, 13, 14, 15, 16, 17, 18, 19, 20, 21, 22:
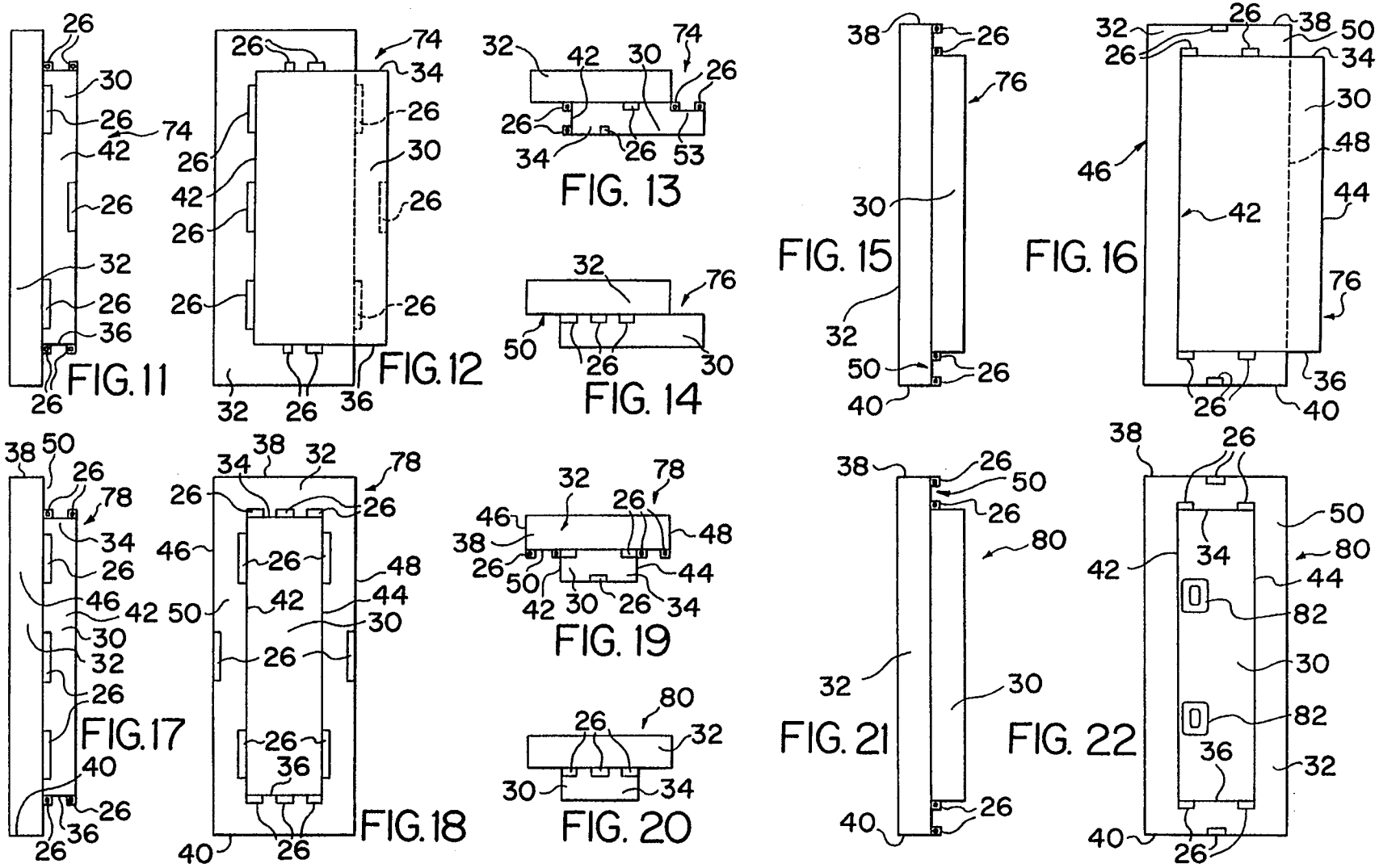
FIG. 11 is a side view of a z-shaped corner assembly panel of the present invention.
FIG. 12 is a front view of the panel shown in FIG. 11.
FIG. 13 is a top, plan view of the panel shown in FIG. 11.
FIG. 14 is a top, plan view of a z-shaped top assembly panel of the present invention.
FIG. 15 is a side view of the panel shown in FIG. 14.
FIG. 16 is a front view of the panel shown in FIG. 14.
FIG. 17 is a side view of a t-shaped base assembly panel of the present invention.
FIG. 18 is a front view of the panel shown in FIG. 17.
FIG. 19 is a top, plan view of the panel shown in FIG. 17.
FIG. 20 is a top, plan view of a t-shaped top assembly panel of the present invention.
FIG. 21 is a side view of the panel shown in FIG. 20.
FIG. 22 is a front view of the panel shown in FIG. 20.

Turning to FIGS. 11–13, a z-shaped corner assembly panel 74 is shown. As can be seen in the top, plan view of FIG. 13, this panel 74 also has a z-shape. The inner portion 30 has only two channels 26 in the two rows on the upper edge 34 of inner portion 30. Similarly, the lower edge 36 of inner portion 30 also only has two channels 26 in the two rows. On one side edge 42 of the inner portion 30, two rows of channels 26 are located. The other rows of channels 26 are provided on the outer face 53 of the inner portion 30.

Accordingly, it can be seen that the channels in the z-shaped corner assembly panel 74 shown in FIGS. 11–13 are positioned differently from the channels of the z-shaped side assembly panel shown in FIGS. 7–10. In this manner, the panels can be placed together in a jig-saw like manner to form a security enclosure 2.

In FIGS. 14–16, a z-shaped top assembly panel 76 is shown. The two previously described panels 28 and 74 can be used in the sides of the security enclosure. This panel 76 shown in FIGS. 14–16 is intended to be used on the top of the enclosure 2. Of course, any desired positioning for the various panels can be had provided the panels fit together in the jig saw-like manner.

The channels 26 in the z-shaped top assembly panel 76 of FIGS. 14–16 are positioned slightly differently from the previously described channels. There are no channels along the side edges 42, 44 of the inner portion 30 or side edges 46, 48 of the outer portion 32. Instead two rows of channels 26 are provided on the inner face 50 of the outer portion 32 adjacent the upper edge 34 and lower edge 36 of the inner portion 30. These channels 26 are also adjacent to the upper edge 38 and lower edge 40 of the outer portion 32 as seen in FIG. 16.

Turning now to FIGS. 17–19, a t-shaped base assembly panel 78 is shown. As can be seen in FIG. 19, this panel 78 has a t-shape instead of the z-shape as seen previously in FIGS. 9, 10, 13 and 14. The upper and lower edges 34, 36 of the inner portion 30 are shorter than the upper and lower edges 38, 40 of the outer portion 32. The side edges 42, 44 of the inner portion 30 are also shorter than the side edges 46, 48 of the outer portion 32. Accordingly, the edges 34, 36, 42 and 44 of the inner portion 30 are surrounded by the edges 38, 40, 46 and 48 of the outer portion 32.

The channels 26 in this t-shape base assembly panel 78 are again positioned differently from the previously discussed channels. Two rows of channels 26 are positioned on the upper edge 34 and lower edge 36 of the inner portion 30. On the inner face 50 of the outer portion 32, two rows of channels 26 are also provided on each side of the inner portion 30. On one side of the inner portion 30, one row of channels 26 is adjacent the side edge 42 of the inner portion 30. The other channel 26 in this pair is adjacent the side edge 46 of the outer portion 32. The channels on the other side of the inner portion 30 are a mirror image to these described channels.

Another t-shaped panel is shown in FIGS. 20–22. This t-shaped top assembly panel 80 has an inner portion 30 and an outer portion 32. Two rows of channels 26 are positioned on the inner face 50 of the outer portion 32. The side edges 42, 44 of the inner portion 30 have no channels adjacent thereto. Rather, the upper edge 34 and lower edge 36 of the inner portion 30 have two channels each adjacent thereto. The other row of channels 26 in the pair of rows on each side of the inner portion 30 are adjacent the upper edge 38 and lower edge 40 of the outer portion 32 as seen in FIG. 22. This t-shaped top assembly panel 80 is designed to be positioned adjacent the door 18 of the security enclosure 2. This is because door latches 82 are provided on the inner portion 30 of this panel 80. Of course, if these door latches 82 were omitted, this panel 80 can be positioned in any appropriate location within the enclosure 2.

Figure 6:
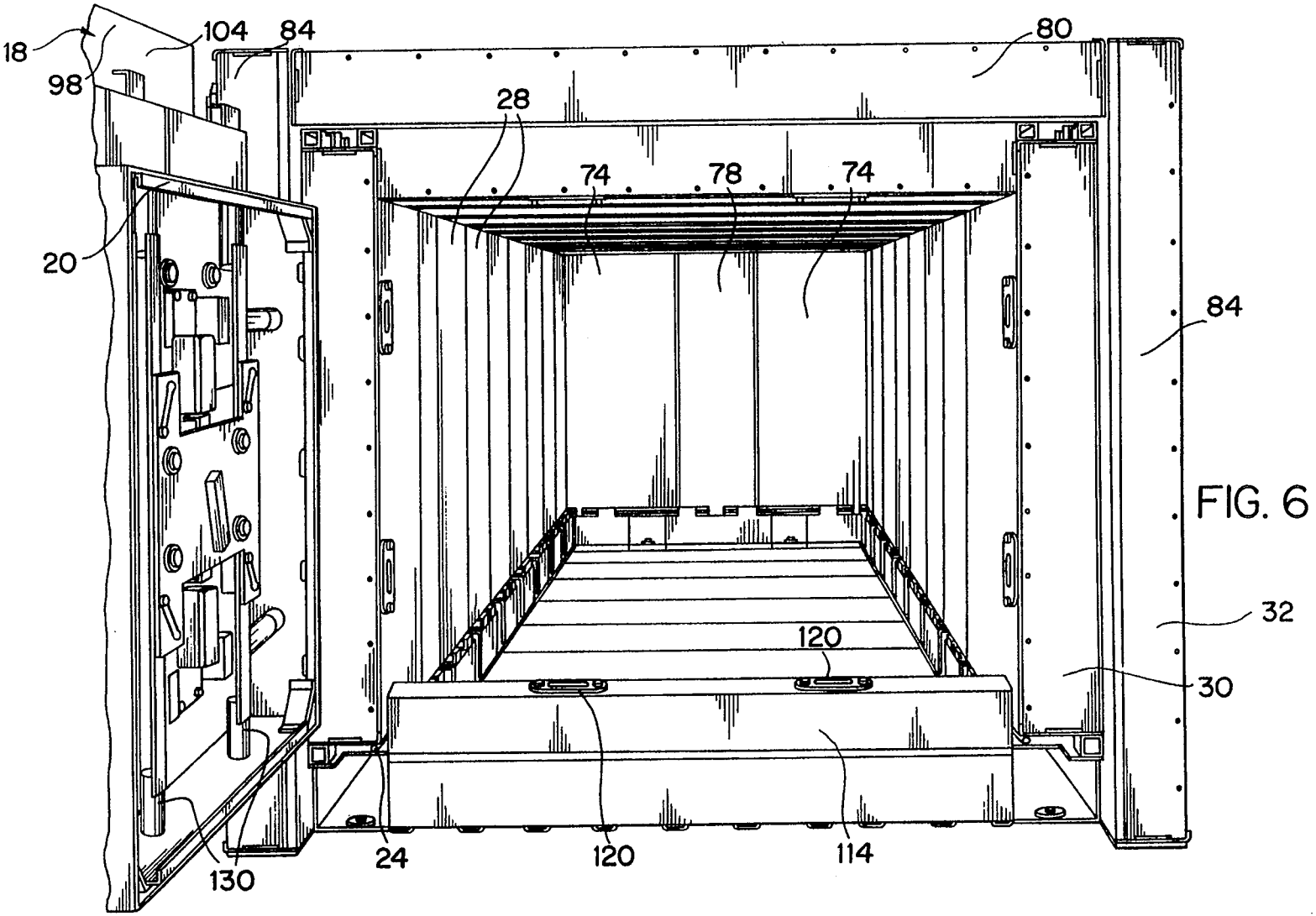
FIG. 6 is an end view of the security enclosure of the present invention with the door in the open position.
Figures 23, 24, 25, 26, 27, 28, 29, 30, 31, 32, 33, 34:
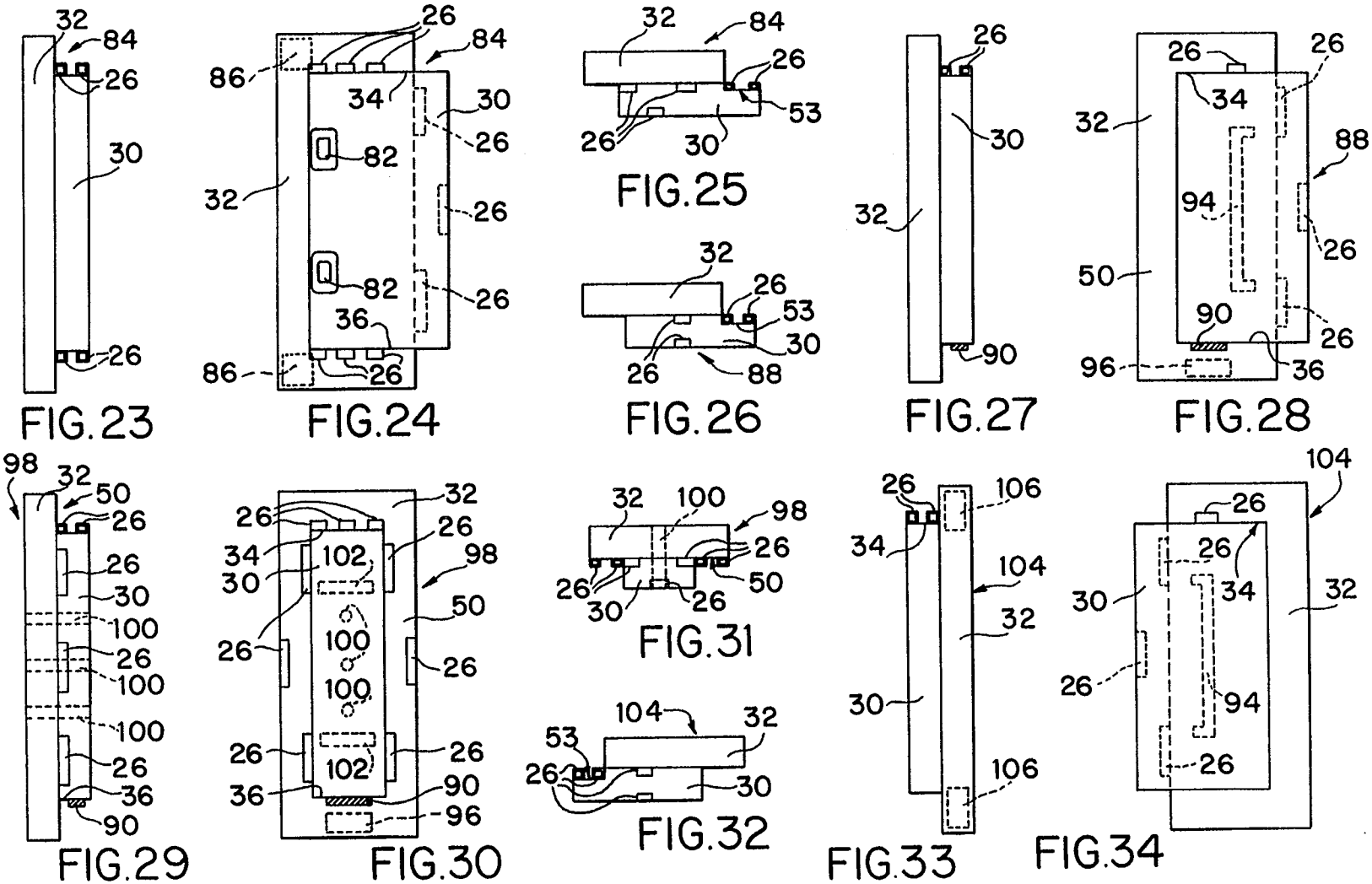
FIG. 23 is a side view of a z-shaped front left side assembly panel of the present invention.
FIG. 24 is a front view of the panel shown in FIG. 23.
FIG. 25 is a top, plan view of the panel shown in FIG. 23.
FIG. 26 is a top, plan view of a z-shaped front right corner assembly panel of the present invention.
FIG. 27 is a side view of the panel shown in FIG. 26.
FIG. 28 is a front view of the panel shown in FIG. 26.
FIG. 29 is a side view of a t-shaped front center assembly panel of the present invention.
FIG. 30 is a front view of the panel shown in FIG. 29.
FIG. 31 is a top, plan view of the panel shown in FIG. 29.
FIG. 32 is a top, plan view of a z-shaped front left corner assembly panel of the present invention.
FIG. 33 is a side view of the panel shown in FIG. 32.
FIG. 34 is a front view of the panel shown in FIG. 32.

Turning now to FIGS. 23–25, a z-shaped front right side or left side assembly panel 84 is shown. The only slight difference between a right side assembly panel or a left side assembly panel is the provision of hinge retaining fixtures 86 on one of the front side assembly panels. These hinge retaining fixtures 86 will receive the hinges for the door 18 so that the security enclosure can open as shown in FIG. 6. Of course, it should be recognized that instead of having the hinge on the left side of the enclosure, the hinge could be provided on the right side of the enclosure and the door would merely open in the opposite direction.

Similarly to the t-shaped top assembly panel 80 discussed with regard to FIGS. 20–22, both the front right or left side assembly panel 84 shown in FIG. 24 has a door latch 82. This door latch 82 will receive a portion of the lock 20 on the door 18.

The front right or left side assembly panel 84 has a z-shape as can be seen in FIG. 25. The channels 26 on this panel 84 are positioned as shown. The upper edge 34 and lower edge 36 of the inner portion 30 each have two rows of channels while the outer face 53 of the inner portion 30 has a single pair of rows of channels 26 as shown in dotted lines in FIG. 24.

In FIGS. 26–28, a z-shaped front right corner assembly panel 88 is shown. This z-shaped front right corner assembly panel 88 has two rows of channels 26 only on the upper edge 34 of inner portion 30. The lower edge 36 of the inner portion 30 has a caster pressure plate 90 affixed thereto. A caster retaining fixture 96 is also provided on the inner face 50 of the outer portion 32. This caster pressure plate 90 and fixture 96 can receive a caster assembly 92 as will be described in more detail below. The use of this caster assembly 92 aids in opening and closing of the door 18.

Apart from the channels 26 on the upper edge 34 of the inner portion 30, the outer face 53 of the inner portion 30 also has two rows of channels 26. A lock retaining fixture 94 is schematically shown in FIG. 28. The lock 20 can be mounted on this fixture 94.

In FIGS. 29–31, a t-shaped front center assembly panel 98 is shown. This panel 98 has a series of channels 26 surrounding the inner portion 30. Two rows of channels 26 are provided on the upper edge 34 of the inner portion 30. On the inner face 50 of the outer portion 32, two rows of channels 26 are also provided on each side of the inner portion 30.

On the lower edge 36 of the inner portion 30, a caster pressure plate 90 is provided. A caster retaining fixture 96 is also provided on the inner face 50 of the outer portion 32.

Through the inner and outer portions 30, 32 of panel 98, a plurality of lock panel feedthroughs 100 are provided. These lock panels feedthroughs 100 will receive a portion of the lock 20. Lock retaining fixtures 102 are provided for mounting the lock 20 thereon.

Turning now to FIGS. 32–34, the z-shaped left corner assembly panel 104 will now be described. Two channels 26 in different rows are provided on the upper edge 34 of the inner portion 30 in this panel 104. Two rows of channels 26 are also provided on the outer face 53 of the inner portion 30. This panel 104 also has a lock retaining fixture 94.

A caster pressure plate 90 and caster retaining fixture 96 are not provided for this z-shaped left corner assembly panel 104. Of course, in order to open and close the door, a caster pressure plate 90 and caster retaining fixture 96 can be provided such that a caster assembly 92 can be mounted on this portion of the door. However, due to the provisions of a plurality of caster assemblies 92 on the z-shaped front right corner assembly panel 88 and the t-shaped front center assembly panel 98, such a caster assembly should be unnecessary on panel 104.

From a review of FIGS. 26–34, the assembly of the door 18 should become apparent. In particular, the panels 88, 98 and 104 can be joined together in order to form door 18. The lock retaining fixtures 94 and 102 and the lock panel feedthrough 100 can be used to mount any suitable lock 20 on this door 18.

When the panels 88, 98 and 104 are placed side-by-side, the various channels 26 will be in alignment. Elongated pins 24 can be fed through these channels in order to hold the door together. Fasteners can be provided at the ends of the pins 24 to prevent removal thereof. However, these fasteners should be readily detachable such that the door can be easily disassembled.

Due to the construction for the door 18 of the present invention, it is not necessary to have special equipment to transport or mount the door on the enclosure 2. Rather, separate panels 88, 98 and 104 can be brought to a sight and then mounted together to form the door. Therefore, the door of the present invention is not unduly heavy. This door can be manually carried to a location of use and easily assembled without any special tools. The door does not create a great weight for the enclosure and can easily be replaced if damaged. Special handling for this door 18 of the present invention is therefore not necessary.

A door hinge fixture 106 is provided on the z-shaped left corner assembly panel 104 as indicated, for example, in FIG. 33. As noted above, the hinge for the door can be mounted on the front right corner assembly panel 88 if the door were to open in an opposite direction.

Figure 35:
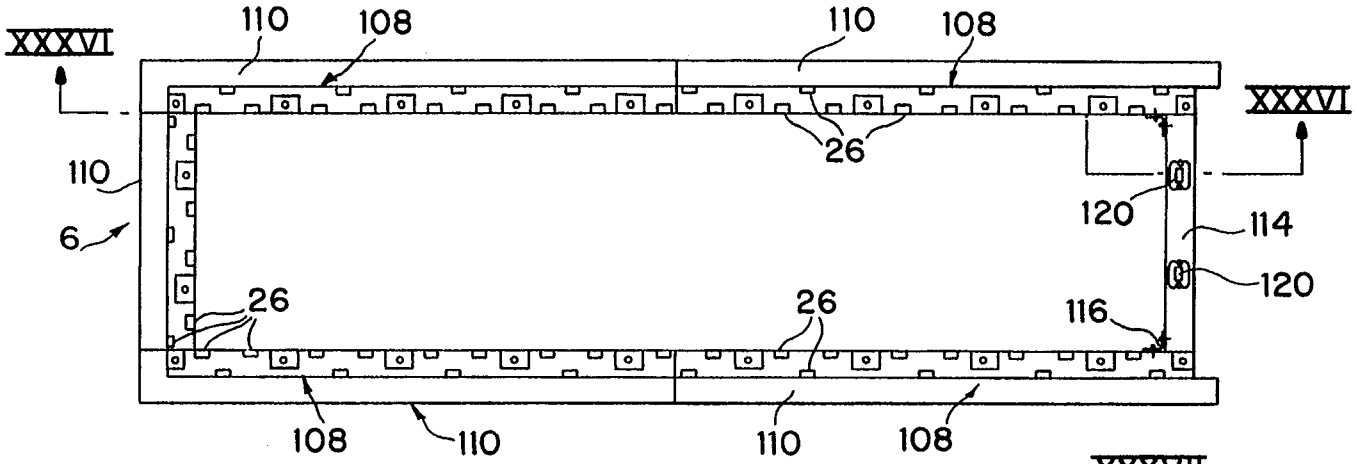
FIG. 35 is a top, plan sectional view of the base member of the present invention.
Figure 36:
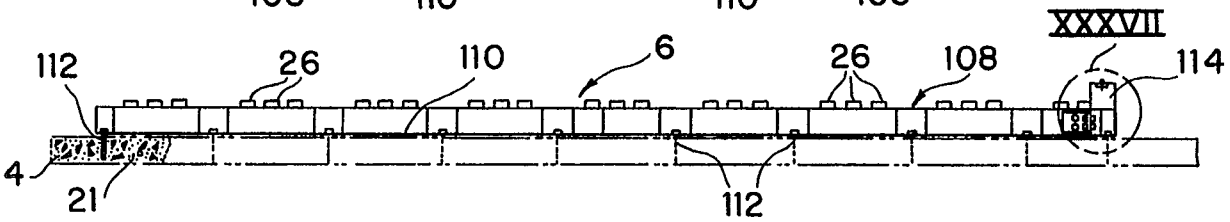
FIG. 36 is a side sectional view of the base member of the present invention taken along line XXXVI of FIG. 35.
Figure 37:
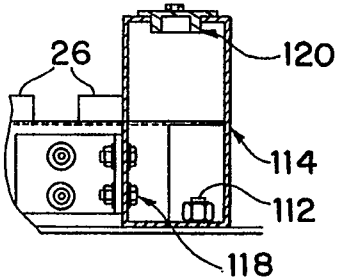
FIG. 37 is an enlarged view of the base member of the present invention taken in the area indicated by circle XXXVII in FIG. 36.

The base member 6 of the present invention is shown in FIGS. 35–37. The base member 6 of the present invention comprises a series of base tubings 108 aligned as shown, for example, in FIG. 35. If the base were to have a different area, different base tubings 108 could be provided. For example, if the front 8 to rear 10 distance for the enclosure 2 were increased, additional base tubings 108 can be provided along each side of the base member 6. While base tubings having a certain length are shown in FIG. 35, it should be recognized that any suitable length for the base tubings can be used. Also instead of using two base tubings 108 on each side of enclosure 2 as indicated in FIG. 35, any suitable number of base tubings can be used. The size of enclosure 2 can therefore easily be varied.

Beneath each of the base tubings 108 is a base plate 110. A separate base plate 110 is shown for each base tubings 108. Of course, a single base plate 110 can be used if so desired.

As best seen in FIG. 36, the base tubings 108 are secured to surface 4 through the base plates 110 by screws 112. Wedge anchors or any suitable means for affixing the base tubings 108 and base plates 110 to surface 4 can be used.

In FIG. 36, the surface 4 is shown as a concrete floor. Of course, any suitable surface can be used. It is merely necessary that the commercial anchors or screws 112 can securely mount the base tubings 108 and base plates 110 thereto.

At the front 8 of enclosure 2, a door base tubing 114 is provided. A base bracket 116 can be used to detachably affix this door base tubing 114 to the base tubings 108 by screws or any suitable means. Any suitable means for rigidly securing the door base tubing 114 and base tubings 108 can be used. This attachment should nonetheless permit disassembly of the bases tubings 108 and door base tubing 114. Because of this disassembly feature with the ability of the base tubings 108 and base plates 110 to be removed from surface 4 by removal of screws 112, the entire enclosure 2 of the present invention can readily be disassembled and moved as needed.

On an upper side of the door base tubing 114, a suitable number of door latches 120 can be provided. These door latches will receive the locking pins 130 of lock 20 when the door is in the closed position.

In certain arrangements this base member 6 can be omitted. In particular, if surface 4 is not sufficiently secure, top panels 76 and 80 can be mounted beneath the side panels. For example, if the enclosure 2 was placed in a van or the like, top panels 76,80 can be used as floor panels to provide a sixth side. These top panels 76,80 would provide additional security. In such an arrangement, the channels 26 on the side panels would be aligned with channels 26 on the top panels (which are on surface 4). Elongated top pins 24 would tie these panels together to form a six sided enclosure 2.

These top panels 76,80 (on surface 4) can be adhered to the surface 4 if necessary. For example, all or selected ones of the panels 76,80 adjacent surface 4 can be bolted, welded, glued or otherwise mounted on the surface 4. Due to the weight of enclosure 2, however, it may be acceptable to omit any type of mounting arrangement between the panels 76,80 and surface 4.

Figure 39:
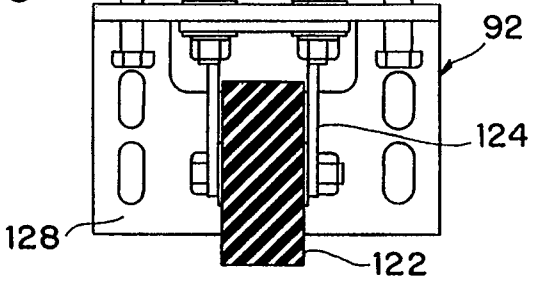
FIG. 39 is a front view of the caster assembly of the present invention.
Figure 38:
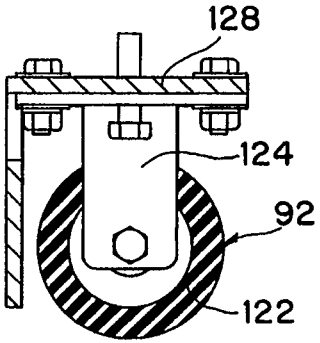
FIG. 38 is a side view of a caster assembly of the present invention.

In FIGS. 38 and 39, the caster assembly 92 is shown. This caster assembly 92 comprises a wheel 122 with suitable bracket 124. The bracket can be affixed by bolts 126 or otherwise affixed to the angled plate 128. This plate 128 can be mounted on the caster pressure plate 90 and caster retaining fixture 96 as shown in FIGS. 28 or 30. Use of this caster assembly 92 will aide in opening and closing of the door 18.

Now that the individual panels 22 of the present invention have been described, the assembly of the security enclosure 2 of the present invention will now be described with reference to FIGS. 3 and 5. In FIG. 5, the inside of the door 18 is shown. As noted above, the panels 88, 98 and 104 can be placed together in order to form this door 18. Some of the channels 26 for receiving an elongated pin 24 are shown in this figure. As previously noted, a suitable fastener can be placed at the end of these pins 26 to securely hold the panels together.

A lock mechanism 20 can be mounted on the interior of the inner portions 30 of these panels 88, 98 and 104. Screws or other suitable locks 140 can be provided for mounting this lock 20 on the assembled door 18. The lock 20 has locking pins 130 which will engage the various door latches 120 of the door base tubing 114 and the door latches 82 of the front right or left side assembly panel 84 and the t-shaped top assembly panel 80. When these locking pins 130 are engaged in these door latches 82, 120, the door 18 will be in a closed, locked position. In such a position, the contents of the enclosure 2 are secured. The lock 20 has a lock handle 132 as seen in FIG. 3 extending outside the enclosure 2. This lock handle 132 is used to operate lock 20.

FIGS. 3 and 4 show the cross-section of the enclosure 2 after it is assembled. The door 18 is provided at the front 8 of enclosure. Along the side of the enclosure are z-shaped front right or left side assembly panels 84. The difference between the left-side assembly panel and the right-side assembly panel is the provision of a hinge 134 as noted above. If hinge 134 is removed when the lock 20 is locked, door 18 cannot be removed. Pins 130 will hold the door in position. These hinges 134 merely aid opening and closing of the door 18.

Extending further along the sides of the enclosure 2 are z-shaped side assembly panels 28. At the rear of the enclosure, z-shaped corner assembly panels 74 are provided with a t-shaped base assembly panel 78.

After the sides of the enclosure 2 are assembled, the top 16 of the enclosure can be put together. The t-shaped top assembly panel 80 is positioned adjacent the door 18. This panel 80 has a door latch 82 for receiving the locking pins 130 of lock 20. Positioned rearwardly from the t-shaped top assembly panel 80 are z-shaped top assembly panels 76.

Assembly of the enclosure 2 of the present invention will now be described. This assembly can easily be carried out without the need for special equipment or skilled personnel. The base plates 110 can be placed on the surface 4. The base tubings 108 are then placed on plates 110 and screws 112 or other suitable anchors affix the base plates 110 and base tubings 108 to surface 4. Of course the base plates 110 can be omitted or can be an integral structure with the base tubings 108.

The z-shaped side assembly panels 28, z-shaped corner assembly panel 74 and t-shaped base assembly panel 78 can sequentially be mounted on the base tubings 108. Channels 26 on the lower edge 36 of inner portion 30 on these panels will align with channels 26 on the upper side of base tubing 108. Elongated pins 24 can be slid through these channels in order to lock the base tubings 108 and side panels 22. Rather than using a single pin extending for the entire length of the enclosure, multiple pins can be secured together in any known fashion. It is possible for a series of pins 24 to be threaded through channels 26 with the first pin being screwed into a nut on the rearmost panel. The last inserted pin 24 can have a bolt and washer secured thereto which can be used to tighten the series of pins 24 and pull adjacent panels 22 together. The pins 24 act as a single member to pull the panels 22 together.

The enclosure is easily expandable or contractible during assembly as needed. When the adjoining panels are placed next to one another, the channels along the joints 72 of adjoining panels will be in alignment. Vertically positioned elongated pins 24 can be inserted into the rows of channels in order to affix one panel to the adjacent panel.

It should be noted that due to the overhang of the outer portion 32 of the panels 22, the base tubings 108 will be concealed from the outside of enclosure 2. Therefore, the screws 112 cannot be removed from the exterior of enclosure 2.

After the five side panels are mounted on the base tubings 108 and are affixed together in this example, the z-shaped and t-shaped top assembly panels 76, 80 can be mounted on the existing panels (the base structure). Similarly to the previously described arrangement, elongated pins 24 can be inserted into mating channels on the top assembly panels in order to affix the top assembly panels to one another and to affix these panels to the existing base structure. After the top panels are placed on the enclosure, the door can be mounted on hinges 134 after the panels 88, 98 and 104 are affixed together and the lock 20 is placed thereon.

Figure 40:
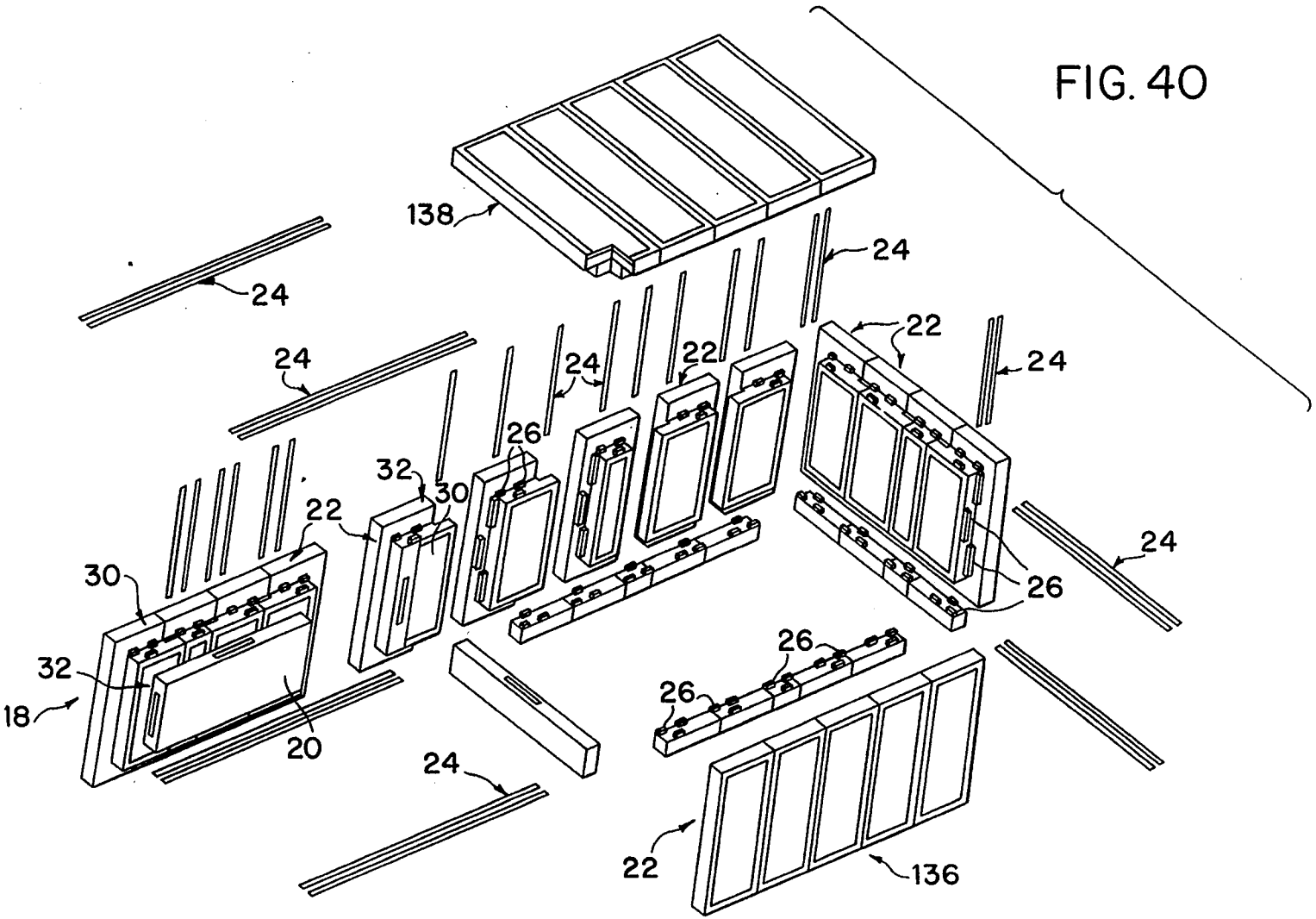
FIG. 40 is an exploded view of a modified embodiment of the security enclosure of the present invention.

While a particular arrangement for an enclosure has been shown in FIGS. 3 and 4, it should be noted that any combination of panels 22 can be had. For example, in FIG. 40 of the present invention, a second arrangement 136 for an enclosure is shown. In this enclosure 136 of the second embodiment, only five panels extend on the length of the enclosure while four panels are along the front and rear sides thereof. The door 18 is formed from one set of these four panels. The forwardmost panel 138 of the five top panels is broken away in this FIG. 40 to show the inner and outer portions thereof. The elongated pins 24 are shown as single pins in this embodiment. However, it should be understood that pins of varying length can be fitted together as needed.

The enclosures 2 and 138 of the present invention provide for temporary security storage of valued assets. The level of security can be varied depending upon the types of materials used in the construction of the panels 22. It is therefore possible to provide for very high-security to minimal security.

These enclosures have military applications such as protection of weapons and other high-valued assets. For the State Department, such an enclosure can be used for protection of documents in embassies. Local law enforcement can use such an enclosure for protection of drugs used as evidence, protection of weapons, etc. There are also commercial applications for the present enclosure. For example, this enclosure can protect money or documents in banks, etc., protection of property of a business and the protection of property in construction sites. Of course, this enclosure also has equal applications in residential settings.

Due to the pin connection design and the overlapping joint arrangement of the panels, quick assembly and disassembly of the enclosure can be had. In addition, the pin connection design provides an easy method of constructing an enclosure of various sizes to meet a specific application. By simply adding wall and top panels, an enclosure can be expanded in size as needed.

Because of the unique pin construction and overlapping joint arrangement, a sequence of assembling steps are required to assemble the enclosure. Particular panels must be erected first before other panels can be added to construct this enclosure. As a result, once the door is closed and locked, all pin connections are concealed and inaccessible. Direct access to the connections from either the outside or inside of the enclosure is not possible. Therefore, if an adversary were to penetrate the enclosure, the removing of further panels to provide easier access would not be possible. This provides for a high level of safeguards and security in that no one panel or connection is a vulnerable point.

Due to the use of relatively light panels and the avoidance of conventional heavy doors, the pieces of the present enclosure can be manually transported to the needed site and easily assembled with no special equipment. Accordingly, the present enclosure can be set up in areas which normally could not utilize a vault. As a result, the present enclosure allows for a temporary high-security storage of valued assets. The cost for this enclosure is relatively low. This cost is further decreased in that the present enclosure can be reused any number of times and lengthy construction time is not needed for assembly or disassembly of this enclosure. Moreover, limited to no maintenance is necessary for this enclosure.

Accordingly, a transportable, reusable rapidly assembled and disassembled resizable modular, security enclosure has been provided by the present invention. Of course, many modifications can be made to this enclosure without departing from the invention. Such variations are not to be regarded as a departure from the spirit and scope of the present invention, and all such modifications as would be obvious to one skilled in the art are intended to be included within the scope of the following claims.

We claim:

1. A modular, security enclosure comprising:

a plurality of panels having interfitting stepped edges, each panel having a rectangular inner portion with an inner face and a rectangular outer portion with an outer face, both the inner portion and the outer portion having a plurality of edges, the edges of the inner portion being offset from the edges of the outer portion, joints being formed between the inner portion and the outer portion of the panels, with only one joint being formed for each edge of the inner portion, each joint having two sides;

a plurality of channels being affixed to at least one of the sides of selected joints of the panels, each side of the joints having a channel affixed thereon having two rows of channels, the channels being covered by the outer portion to be concealed and inaccessible from an exterior of the enclosure; and elongated pins extending through the channels along the joints when the panels are interfit together, said elongated pins extending generally parallel to the joints in which the pins are located, the elongated pins being readily insertable into and readily removable from the channels in a predetermined sequence, the pins being concealed and inaccessible from the inner and outer faces of the panels when the pins are in the channels, the outer portion of the panels being movable in a direction away from where the channels receive the pins when the elongated pins are removed to expose the channels to the exterior of the enclosure.

2. The modular, security enclosure as recited in claim 1, wherein each of the joints have two sides, at least one of the sides of the joints having elongated pins provided adjacent thereto when the panels are fit together, each elongated pin being generally straight, being hidden from view and being inaccessible from the inner and outer faces of the panels when the elongated pins are in the channels.

3. The modular, security enclosure as recited in claim 2, wherein four edges are provided for both the inner face and the outer face of each of the panels, the elongated pins being generally parallel to the inner and outer faces of panels adjacent thereto when the elongated pins are in the channels.

4. The modular, security enclosure as recited in claim 1, wherein each of the panels comprises layers of selected barrier materials.

5. The modular, security enclosure as recited in claim 1, wherein a varying number of panels can be interfit together in order to vary size of the enclosure.

6. The modular, security enclosure as recited in claim 1, further comprising a base member surrounding a lower side of the enclosure, panels being sequentially affixed to the base member during assembly of the enclosure, the base member having a plurality of channels provided on an upper side thereof which mate with channels on adjoining panels, elongated pins being insertable through the channels on the base member and the adjoining panels in order to affix the panels to the base member.

7. The modular, security enclosure as recited in claim 6, wherein the outer portions of the panels mounted on the base member overhang the base member and have a lower edge which is adjacent the surface on which the enclosure is located such that the base member is concealed and inaccessible from an outer side of the enclosure.

8. The modular, security enclosure as recited in claim 1, further comprising a hinged door detachably mounted on a side of the enclosure and lock means for locking the door in a closed position when the door is mounted on the enclosure, the door being made from a plurality of the panels.

9. The modular, security enclosure as recited in claim 1, wherein some of the panels are z-shaped panels, the inner portion and the outer portion of the z-shaped panels each have an upper edge, a lower edge and two side edges, the upper and lower edges of the inner portions and outer portions of the z-shaped panels generally having a same length while the side edges of the inner portions of the z-shaped panels are shorter than the side edges of the outer portions of the z-shaped panels, the upper and lower edges of the inner portion of each z-shaped panels being between the upper and lower edges of the outer portion while only one side edge of the inner portion is located between the side edges of the outer portion such that the inner and outer portions overhang one another on opposed sides thereof to form generally a z-shaped panel with the edges of the panels being stepped.

10. The modular, security enclosure as recited in claim 1, wherein some of the panels are t-shaped, the inner portion and the outer portion of the t-shaped panels each have an upper edge, a lower edge and two side edges, the upper and lower edges of the inner portions of the t-shaped panels being shorter than the upper and lower edges of the outer portions and the side edges of the inner portions of the t-shaped panels being shorter than the side edges of the outer portions, the edges of the inner portion of each t-shaped panel being surrounded by edges of the outer portion to form generally a t-shaped panel such that the edges of the panels are stepped.

11. The modular, security enclosure as recited in claim 1, wherein the panels are z-shaped or t-shaped, the inner portion and the outer portion of the panels each have an upper edge, a lower edge and two side edges, the z-shaped panels being one of a side assembly panel, a corner assembly panel, a top assembly panel, a front right side assembly panel, a left front side assembly panel, a front right corner assembly panel and a front left corner assembly panel and the t-shaped panels being one of a base assembly panel, a top assembly panel and a front center assembly panel, the upper and lower edges of the inner portions and outer portions of the z-shaped panels generally having a same length while the side edges of the inner portions of the z-shaped panels are shorter than the side edges of the outer portions of the z-shaped panels, the upper and lower edges of the inner portion of each z-shaped panel being between the upper and lower edges of the outer portion while only one side edge of the inner portion is located between the side edges of the outer portion such that the inner and outer portions overhang one another on opposed sides thereof to form generally a z-shaped panel, the upper and lower edges of the inner portions of the t-shaped panels being shorter than the upper and lower edges of the outer portions and the side edges of the inner portions of the t-shaped panels being shorter than the side edges of the outer portions, the edges of the inner portion of each t-shaped panel being surrounded by edges of the outer portion to form generally a t-shaped panel.

12. The modular, security enclosure as recited in claim 11, wherein each of the side assembly panels of the z-shaped panels have two rows of channels on the upper edge and the lower edge of the inner portion of the panel and wherein vertically extending joints between the inner portion and outer portion of each z-shaped side assembly panel have two pairs of channels, a first one of the pair of channels comprises two rows of channels located on an inner face of the outer portion of the z-shaped panel and a second one of the pair of channels comprises two rows of channels located on an outer face of the inner portion of the z-shaped panel.

13. The modular, security enclosure as recited in claim 11, wherein each of the corner assembly panels of the z-shaped panels have two rows of channels on the upper edges, the lower edges and one of the two side edges of the inner portion of the panel, a side edge of the inner portion of the panel opposite to the side edge having the two rows of channels forming a joint with two rows of channels being provided on an outer face of the inner portion of the panel.

14. The modular, security enclosure as recited in claim 11, wherein the top assembly panels of the z-shaped panels and the t-shaped panels each have two opposed shorter joints and two opposed longer joints, the top assembly panels further having two rows of channels on the inner face of the outer portion of the panel at each of the shorter joints.

15. The modular, security enclosure as recited in claim 11, wherein each of the base assembly panels and the front center assembly panels of the t-shaped panels have two rows of channels on at least the upper edges of the inner portion of the panels and wherein the inner face of the outer portion of each of the base assembly panels and the front center assembly panels have two rows of channels on each side of the inner portion of the t-shaped panels.

16. The modular, security enclosure as recited in claim 11, wherein each of the front right side assembly panels and each of the front left side assembly panels of the z-shaped panels have two rows of channels on the upper and lower edges of the inner portions of the panels and wherein each of the front right side assembly panels and each of the front left side assembly panels of the z-shaped panels have two rows of channels on an outer face of the inner portion of the panels, the two rows of channels on the outer face of the inner portion of the front right side assembly panels and the front left side assembly panels being on only one side of the outer portion of the panels.

17. The modular, security enclosure as recited in claim 11, wherein each of the front right corner assembly panels and each of the front left corner assembly panels of the z-shaped panels have two side-by-side channels on the upper edge of the inner portion of the panel and wherein each of the front right corner assembly panels and each of the front left corner assembly panels of the z-shaped panels have two rows of channels on an outer face of the inner portion of the panels, the two rows of channels on the outer face of the inner portion of the front right corner panel assembly and the front left corner panel assembly being on only one side of the outer portion of the panels.

18. The modular, security enclosure as recited in claim 11, wherein the enclosure is a bank vault and wherein each of the panels have barrier material therein.

19. The modular, security enclosure as recited in claim 1, further comprising a lock with a plurality of sides, the lock being mounted on a door to the enclosure, the lock having means on each side for engaging the enclosure and holding the door in a closed position.

20. A method for assembling a modular, security enclosure comprising the steps of:

placing a base member to a surface on which the enclosure is to be located, the base member having a plurality of channels in two rows on a top surface thereof;

placing a series of panels on the base member, the panels each having a rectangular inner portion and a rectangular outer portion, most of the panels having channels on a lower side thereof which align with one of the two rows of channels on the base member;

covering the base member with an outer portion of the panels when the panels are placed on the base member such that the base member is concealed and inaccessible from an exterior of the enclosure;

inserting a plurality of pins into the rows of channels on the base member and the panels, the channels on the base member and the panels being staggered such that the panels are detachably secured to the base member upon insertion of the pins into the channels;

providing interfitting stepped edges along sides of the panels which interfit when the panels are placed on the base member;

providing channels on joints in the panels;

inserting pins into the channels of adjoining panels to thereby detachably lock the adjacent panels together to form a base structure, the pins being readily removable from the channels;

placing top panels on the base structure, the tops of the panels of the base structure and the top panels both having mating channels;

inserting pins into the channels between the panels of the base structure and the top panels to detachably secure the top panels to the base structure, the pins being readily removable from the channels;

covering the channels by the outer portions of the panels such that the channels are concealed and inaccessible from the exterior of the enclosure;

placing a door on a forward end of the enclosure, the door being movable between an open and closed position; and covering ends of pins between the base member and the panels of the base structure and ends of pins between the base structure and the top panels with the door only when the door is in the closed position.

21. A modular, security enclosure made in accordance with the steps of claim 20.

22. The method as recited in claim 20, wherein the steps of inserting pins on the base member and panels, inserting pins between adjoining panels and inserting pins between the base structure and the top panels comprises the step of using at most two pins per edge for each of the panels.

* * * * *